United States Patent [19]

Yokoi

[11] Patent Number: 4,723,857

[45] Date of Patent: Feb. 9, 1988

[54] PRINTER WITH A PLASTIC FRAME STRUCTURE

[75] Inventor: Takeshi Yokoi, Kagamihara, Japan

[73] Assignee: Brother Kogyo Kabushiki Kaisha, Japan

[21] Appl. No.: 799,695

[22] Filed: Nov. 19, 1985

[30] Foreign Application Priority Data

Nov. 20, 1984 [JP] Japan ..... 59-175810[U]
Nov. 20, 1984 [JP] Japan ..... 59-175816[U]

[51] Int. Cl.[4] ..... B41J 29/07; B41J 29/08

[52] U.S. Cl. ..... 400/693; 400/352; 400/689; 400/719

[58] Field of Search ..... 400/352, 353, 354, 320, 400/341, 691, 692, 693, 694, 679, 719, 689, 648

[56] References Cited

U.S. PATENT DOCUMENTS

| | | | |
|---|---|---|---|
| 4,108,297 | 8/1978 | Dürr et al. | 400/691 X |
| 4,150,903 | 4/1979 | Bailey et al. | 400/694 X |
| 4,303,013 | 12/1981 | Shinodaira | 400/694 X |
| 4,531,852 | 7/1985 | Mädge et al. | 400/692 |
| 4,549,825 | 10/1985 | Fish, III et al. | 400/693 X |
| 4,568,211 | 2/1986 | Fox et al. | 400/693 X |
| 4,591,284 | 5/1986 | Lim et al. | 400/694 X |

FOREIGN PATENT DOCUMENTS

| | | | |
|---|---|---|---|
| 2941969 | 4/1981 | Fed. Rep. of Germany | 400/693 |
| 92087 | 7/1981 | Japan | 400/691 |
| 62166 | 4/1984 | Japan | 400/353 |
| 877295 | 9/1961 | United Kingdom | 400/691 |

OTHER PUBLICATIONS

IBM Tech. Disc. Bulletin, "Molded Platen Shaft Bearing Assembly for Office Printers and Typewriters", Olson et al., vol. 25, No. 7B, Dec. 1982, pp. 3863–3864.

IBM Tech. Disc. Bulletin, "Frame-Isolation Mount with Balanced Damping", Dorveau et al., vol. 26, No. 1, Jun. 1983, pp. 123–124.

IBM Tech. Disc. Bulletin, "Load Beam Antiwind-up Structure", Wanek, vol. 27 No. 5, Oct. 1984, pp. 2946–2947.

*Primary Examiner*—Edgar S. Burr
*Assistant Examiner*—James R. McDaniel
*Attorney, Agent, or Firm*—Jones, Tullar & Cooper, P.C.

[57] ABSTRACT

A printing mechanism assembly, which includes a platen, a print head opposed to the platen for printing operation, a carriage carrying the print head thereon, and a guide rod for supporting the carriage so as to be movable along a print line, is supported on a plastic subframe. The subframe is provided integrally with channel-shaped reinforcing members extending parallel to the platen at front and rear end portions of the subframe. Each reinforcing member is formed integrally with a number of reinforcing ribs arranged at regular intervals in the longitudinal direction of the member. The subframe is mounted, at its front and rear end portions, on a main frame. For the mounting arrangement, engaging projections are formed on the rear end portion so that they can substantially horizontally engage mounting recesses in the main frame with the aid of vibration-proof rubber members. The front end portion of the subframe is vertically fixed on the main frame by means of fixing screws accompanied by vibration-proof rubber members.

9 Claims, 6 Drawing Figures

PRINTER WITH A PLASTIC FRAME STRUCTURE

BACKGROUND OF THE INVENTION

The present invention relates to a printer in which a print head of e.g. a dot-matrix type is mounted on a carriage and opposed to a platen so as to be movable along a print line for printing operation.

Generally, in printers of this type, a machine frame supporting the platen, carriage and other components is fabricated by bending a metal plate material into a predetermined shape by pressing or the like. The components are mounted on the frame by welding, screwing or other suitable methods.

Thus, in the manufacture of the prior art printers, sheet metal processing for the frame and assembly of the components thereon require much time and labor, lowering working efficiency. Also, the dimensional accuracy of the frame and assembled components is subject to increased variations, and the frame, made of metal, is inevitably heavy in weight.

Since the accuracy of the gap between the platen and the print head opposed thereto, that is, printing gap, greatly influences the print quality of the printer, the frame needs to have a strength high enough to minimize flexure and torsion. In this regard, the metallic frame may provide a measure of strength. However, if a thinner metal plate is used for the frame with the aim of reducing the gross weight of the printer, to meet the needs of the times, reinforcing plates may sometimes be required to insure adequate strength. Thus, the manufacture of the frame takes more time, and it would be impossible to effectively reduce the printer weight.

For the reduction of the frame weight, synthetic resin or plastic material may possibly be used for the frame, in place of the metal material. A plastic frame, however, lacks mechanical strength and cannot be put to practical use in printers.

When manufacturing the printer frame of the aforementioned type with use of a plastic material, therefore, it is necessary to provide a considerably thick structure to resist flexure or torsion, or to reinforce the frame structure with metallic reinforcing members. Even so, the proposed improvement still involves the same problems of the metallic frame, such as increased weight and low working efficiency.

The frame strength also depends on protection of the components of the printing mechanism assembly, such as the print head and platen, against the impact of vibration or other external forces. During the printing operation, moreover, the impact of the print head will cause vibration, which will be transmitted to the frame producing noise, or to a table carrying the printer giving the operator an unpleasant sensation. This would lead to distortion of the components of the printer or loosening of fixing screws, possibly lowering the print quality or causing premature trouble with the printer.

SUMMARY OF THE INVENTION

The object of the present invention is to provide a printer with a plastic frame structure which obviates the above-mentioned drawbacks of the conventional plastic frame, and permits reduction of the printer weight and improved efficiency of manufacture and assembly work, providing necessary mechanical strength for satisfactory durability and high print quality, and effectively restraining production of noise attributed to vibration caused by printing operation and transmission of vibration.

In order to achieve the above object, a printer according to the present invention is constructed so that a plastic subframe is adapted to be mounted on a main frame, and is formed integrally with a channel-shaped reinforcing member which extends parallel to the axis of a platen. The reinforcing member can positively prevent undesired flexure of the subframe along the platen axis or a printing line for printing operation, without requiring any separate reinforcing means. Also, the reinforcing member serves to increase the torsional strength of the frame structure. Thus, the manufacture of the frame structure is easy, and the plastic material for the subframe may be made relatively thin except the region for the channel-shaped shaped reinforcing member. Moreover, the lightness of the plastic material can efficiently be utilized, and the arrangement space for the built-in components is hardly restricted, facilitating lightweight, compact printer design.

Preferably, the channel-shaped reinforcing member is formed integrally with a number of reinforcing ribs for additional strength, which are arranged at regular intervals in the longitudinal direction of the reinforcing member. The ribs serve to further reinforce the frame without substantially increasing the frame weight.

According to a preferred arrangement, channel-shaped reinforcing members are provided individually at the front end portion of the subframe and the rear end portion thereof beside the platen. These two reinforcing members can ensure more satisfactory frame strength.

When setting the printing mechanism assembly on the subframe for unitization so that the subframe is mounted as a unit on the main frame of the printer, in particular, the reinforcing members at the front and rear end portions of the subframe can be seated on the main frame. Thus, the mechanical strength of the mounting portions of the two frames can satisfactorily be maintained for stable mounting.

According to the present invention, furthermore, if the subframe, carrying the printing mechanism assembly thereon, is adapted to be mounted as a unit on the main frame of the printer, vibration-proof means is provided to absorb vibration which may be transmitted through frame mounting means between the two frames.

If the mounting means consists of mating projections and recesses formed between the frames, the vibration-proof means preferably includes vibration-proof rubber members which are each in intimate contact with the outer peripheral surface of each corresponding projection and the inner peripheral surface of the recess. If the mounting means consists of bolts coupling the two frames, the vibration-proof means should preferably be formed of vibration-proof rubber members which are interposed between the two frames and penetrated individually by the bolts.

The aforesaid vibration-proof structure serves to effectively absorb the vibration transferred between the two frames.

In another preferred arrangement of the invention, the subframe is provided, at the rear end portion thereof, with an upwardly concave surface which underlies the platen, extending parallel to the platen axis. The concave surface of the subframe, in conjunction with the cylindrical surface of the platen, defines a guide path along which a printing sheet passes. Thus, the concave surface serves as guide means for the printing sheet, and eliminates the need of any separate guide member.

BRIEF DESCRIPTION OF THE DRAWINGS

These and other objects and advantages of the present invention will be more completely described below with reference to the accompanying drawings, in which.

DETAILED DESCRIPTION OF THE PREFERRED EMBODIMENT

A printer according to the present invention will now be described in detail with reference to the accompanying drawings.

Figure 1:
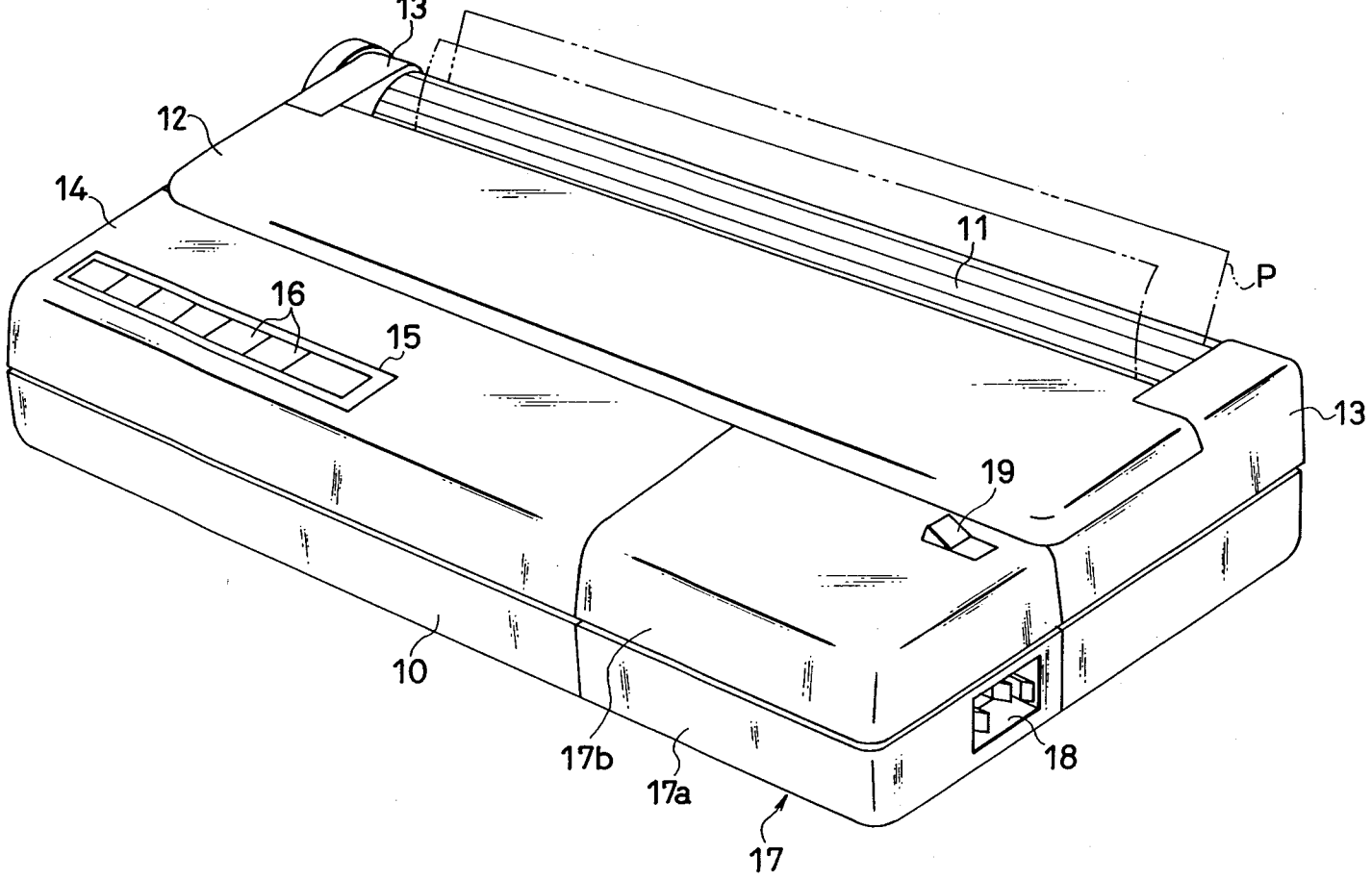
FIG. 1 is a general perspective view of a printer according to the present invention.

FIG. 1 is an exterior view of the printer of the invention, in which a platen 11 having a cylindrical surface is rotatably supported on a main frame 10 in the form of an open-topped box, and a printing sheet P is wound around the platen 11, as indicated by the chain line.

The main frame 10 carries thereon a main cover 12 covering the internal mechanisms, a pair of side covers 13 on either side of the main cover 12, and an operating cover 14 bearing an operating panel 15 with a number of keys 16 thereon. A power supply unit 17 is disposed at one corner portion of the main frame 10, whereby electric power from an external power source is supplied to the printer. A casing **17*a* having a socket 18 to be connected to the external power source and a power supply unit cover 17*b*, along with the main frame 10 and the covers 12, 13 and 14**, define a roundcornered, rectangular outline of the printer.

In the description to follow, that side of the printer on which the platen 11 is located and its opposite side will be referred to as rear and front sides, respectively, and the direction along the axis X-X (FIGS. 2 and 4) of the platen 11 as its longitudinal direction, throughout the several views. Also, those portions of the printer at which the side covers 13 are located will be referred to as its side portions.

Figure 2:
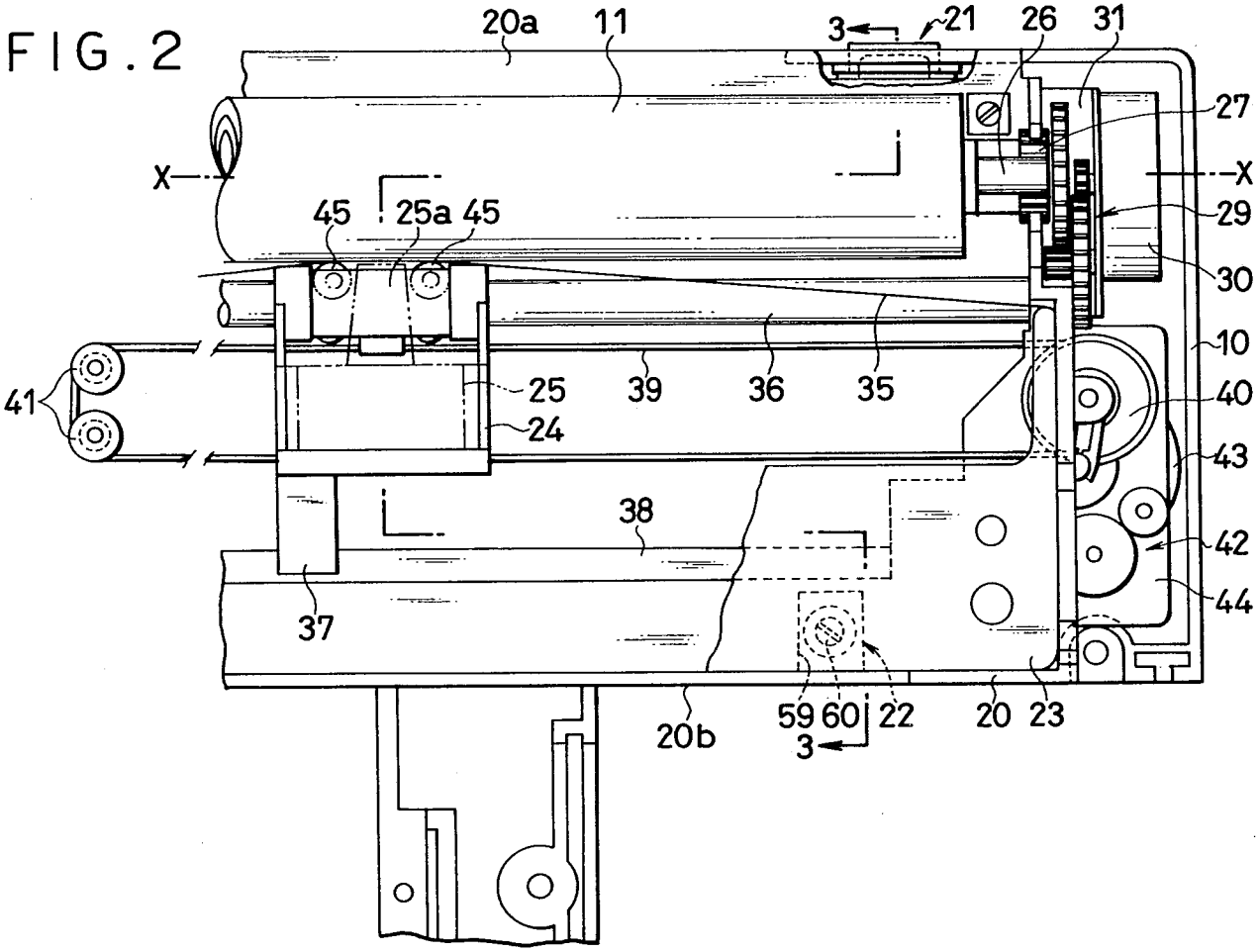
FIG. 2 is a partial, enlarged plan view showing the printer of FIG. 1 with its covers removed to expose a printing mechanism assembly.

In FIG. 2, the covers 12, 13 and 14 are removed for ease of illustration. A subframe 20 made of plastic material is mounted on the rear half portion of the main frame 10 which is also made of plastic material. For this mounting work, a pair of rear mounting portions 21 (only one shown) and a pair of front mounting portions 22 (only one shown) are provided at the rear and front portions, respectively.

Mounted on the subframe 20 are the platen 11, a ribbon cassette 23, and a carriage 24 which carries thereon a print head 25 adapted for dot-matrix printing. The platen 11 is located close to a rear end portion **20*a* of the subframe 20 so that its axis X—X is parallel to the rear end portion 20*a*. A platen shaft 26, extending from each end of the body of the platen 11 to form an end portion thereof, is rotatably supported on the subframe 20 by means of a bearing 27. The platen shaft 26 is fixedly fitted, on its end, with a driven gear 28, which is operatively coupled to a reversible motor 30 for platen drive by means of a gear transmission mechanism 29. The gear transmission mechanism 29 and drive motor 30 are mounted on a support bracket 31 which is fixed on the subframe 20** by means of fitting screws (not shown).

The ribbon cassette 23 (only right-hand portion shown in FIG. 2) has a ribbon 35 which is stretched along a print line extending along the axis X—X of the platen 11.

The carriage 24 is slidably supported, at its rear side, on a guide rod 36 as guide rod means, and can reciprocate the print head 25 along the print line. Extending parallel to the axis X—X of the platen 11, the guide rod 36 is supported on the subframe 20 in the manner mentioned later.

A guide piece 37 integrally protrudes forward from the front portion of the carriage 24 in the horizontal direction. The guide piece 37 is in slidable contact with a stepped guide surface 38 which extends in the longitudinal direction of the printer, located close to a front end portion **20*b* of the subframe 20**.

The carriage 24 is fixed to a toothed, endless drive belt 39. The right end portion of the loop of the belt 39 is wound around a driving pulley 40, and the left end portion around a pair of guide pulleys 41. The driving pulley 40 is operatively coupled to a reversible motor for carriage drive by means of a gear transmission mechanism 42. The driving pulley 40, gear transmission mechanism 42, and motor 43 are mounted on a support bracket 44, which is fixed on the subframe 20 by means of screws (not shown) or the like.

When the drive motor 43 rotates in one direction, the belt 39 is driven in one direction by the gear transmission mechanism 42 and driving pulley 40. As a result, the carriage 24, supported by the guide rod 36 and guide surface 38, moves in one direction, thereby transporting the print head 25 along the print line. While this is done, impact printing on the printing sheet P is performed on the platen 11 using the ribbon 35.

The print head 25 is located so that its distal end portion **25*a* closely faces the platen 11, and the gap between the facing portions, i.e., printing gap, is determined when a pair of gap setting rollers 45 engage the peripheral surface of the platen 11**.

Thus, the platen 11, ribbon cassette 23, print head 25, carriage 24, and drive mechanism sections for these components are all mounted on the subframe 20, constituting one unit.

The drive of the ribbon 35 is performed when the cassette 23 is mounted on the subframe 20 to be operatively coupled to the gear transmission mechanism 42 for carriage drive (not shown in detail).

Figure 3:
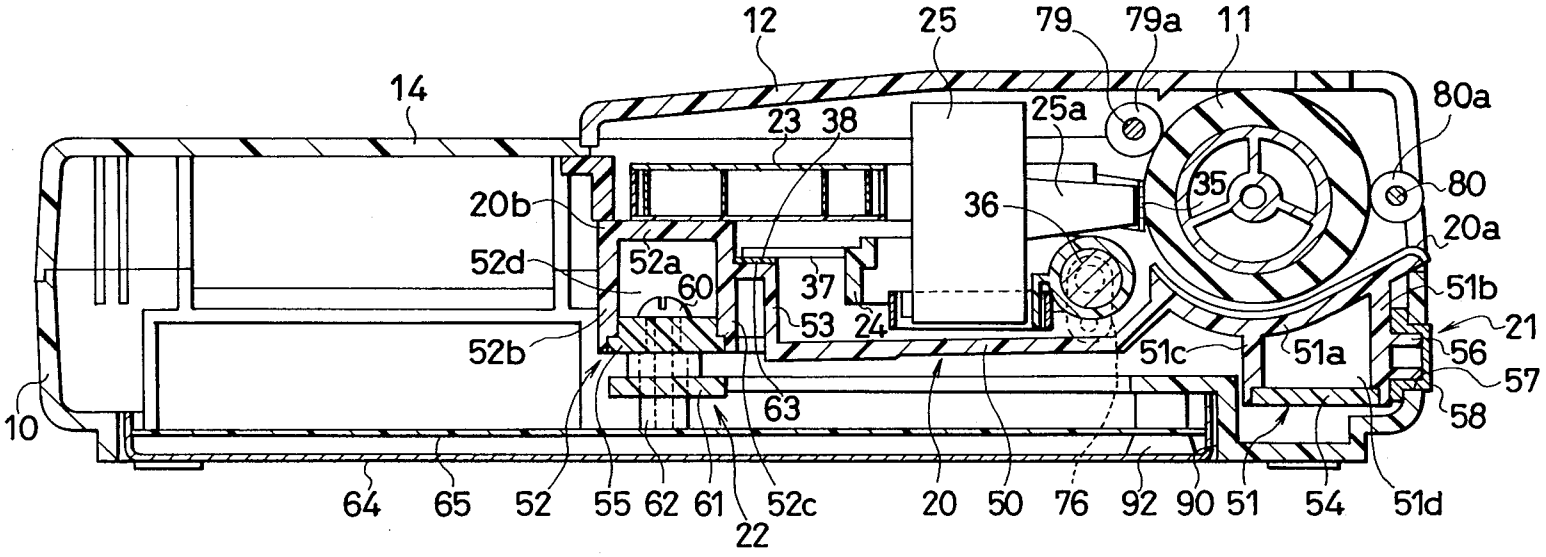
FIG. 3 is a vertical sectional view of the printer with its covers thereon, as taken along line 3—3 of FIG. 2.

As shown in FIG. 3, the subframe 20 includes a substantially horizontal bottom plate 50, channel-shaped reinforcing members 51 and 52 formed integrally on the bottom plate 50 at the rear and front end portions **20*a* and 20*b*, respectively, and a stepped portion 53 for the guide surface 38 adjoining the front reinforcing member 52. These portions or members are integrally formed in molding the subframe 20**.

The reinforcing members 51 and 52 each have an inverted-U-shaped cross section, opening downward. Each reinforcing member 51, 52 includes a top wall **51*a*, 52*a* and a pair of side walls 51*b* and 51*c*; 52*b* and 52*c* vertically hanging from the top wall 51*a*, 52*a* and extending parallel to the axis X—X of the platen 11, thus defining therein an open-bottomed channel 51***d*, 52*d* extending in the longitudinal direction.

The subframe 20 is provided, at the rear end portion 20*a*, with an upwardly concave surface which underlies the platen 11, extending parallel to the platen axis, as shown in FIG. 3. The concave surface of the subframe 20, in conjunction with the cylindrical surface of the platen 11, defines a guide path along which the printing sheet P passes. Thus, the concave surface serves as guide means for the printing sheet P.

As shown in FIG. 3, the rear reinforcing member 51 is located under a curved wall portion which has the upwardly concave surface as its upper surface and is continuous with the bottom plate 50. The top wall 51*a* is a part of the curved wall portion.

The front reinforcing member 52 projects above the surface level of the bottom plate 50 which is located beneath the carriage 24, as shown in FIG. 3. The side walls 51*b* and 52*b* of the rear and front reinforcing members 51 and 52 define rear and front vertical walls of the subframe 20, respectively.

Strip-shaped plastic lid plates 54 and 55 are fixedly bonded to the bottom openings of the reinforcing members 51 and 52, respectively, so as to close the same. Thus, each reinforcing member 51 (52) is in the form of a hollow pillar.

The mounting portions 21 and 22 for mounting the subframe 20 on the main frame 10 will now be described.

The rear mounting portion 21 includes engaging projections 56 protruding integrally from the outer surface of the side wall 51*b* of the rear reinforcing member 51, in a substantially horizontal direction, and engaging holes 57 formed in a rear wall 10*a* of the main frame 10 so as to correspond to the engaging projections 56. The projections 56 are adapted to be fitted individually in the holes 57. A vibration-proof rubber member 58 is interposed between each combination of projection 56 and hole 57, enjoying intimate contact with both the outer peripheral surface of the projection 56 and the inner peripheral surface of the hole 57.

The engaging holes 57 may be in the form of a depression, instead of being an aperture. Also, the projections 56 and the holes 57 may be provided on the sides of the main frame 10 and the subframe 20, respectively.

At the front mounting portion 22, on the other hand, bolts 60 are downwardly inserted into their corresponding mounting holes 59 (FIGS. 3, 4, 5 and 6) formed in the opposite end portions of the front reinforcing member 52, and are screwed individually into tapped holes of mounting members 61 formed on the main frame 10. Vibration-proof rubber members 62 are interposed between their corresponding mounting members 61 of the main frame 10 and the reinforcing member 52 of the subframe 20, and are fixed in a slightly compressed manner by the bolts 60. Each rubber member 62 is formed with an insertion hole 62*a* through which the bolt 60 is passed.

Thus, the subframe 20 is mounted on the main frame 10 at the locations of the rear and front reinforcing members 51 and 52 corresponding to the mounting portions 21 and 22, enjoying a stable mounting state. Provided at the mounting portions 21 and 22, moreover, the vibration-proof rubber members 58 and 62 can absorb vibration which may be transmitted through the mounting portions 21 and 22 to the frames 10 and 20. Accordingly, the vibration produced during the printing operation is removed while it is transmitted from the subframe 20 to the main frame 10, so that the operator can avoid being troubled with noise or any other offensive sensation.

In mounting the subframe 20 on the main frame 10, the projections 56, at the rear mounting portion 21, are first caused to backwardly engage their corresponding engaging holes 57 in a substantially horizontal direction. Then, at the front mounting portion 22, the bolts 60 are vertically downwardly fixed to complete the mounting work. Thus, since the mounting directions at the front and rear mounting locations are substantially normal to each other, it is possible to effectively prevent dislocation between the main frame 10 and the subframe 20.

A friction sheet 63, formed of e.g. Teflon (trademark), is bonded to the top face of the stepped portion 53, defining the guide surface 38. Owing to its material, the friction sheet 63 can positively resist abrasion attributed to slide contact with the guide piece 37, and serves to keep the carriage 24 from being subjected to high sliding resistance.

Thus, the carriage 24 is supported by the guide rod 36 and the guide surface 38 at the rear and front portions thereof, respectively.

A bottom cover 64 with a printed board 65 is attached to the bottom of the main frame 1 from under the same. The printed board 65 constitutes a control circuit means for controlling the operation of the printer. The bottom cover 64 will be described further in detail with reference to FIG. 5.

Figure 4:
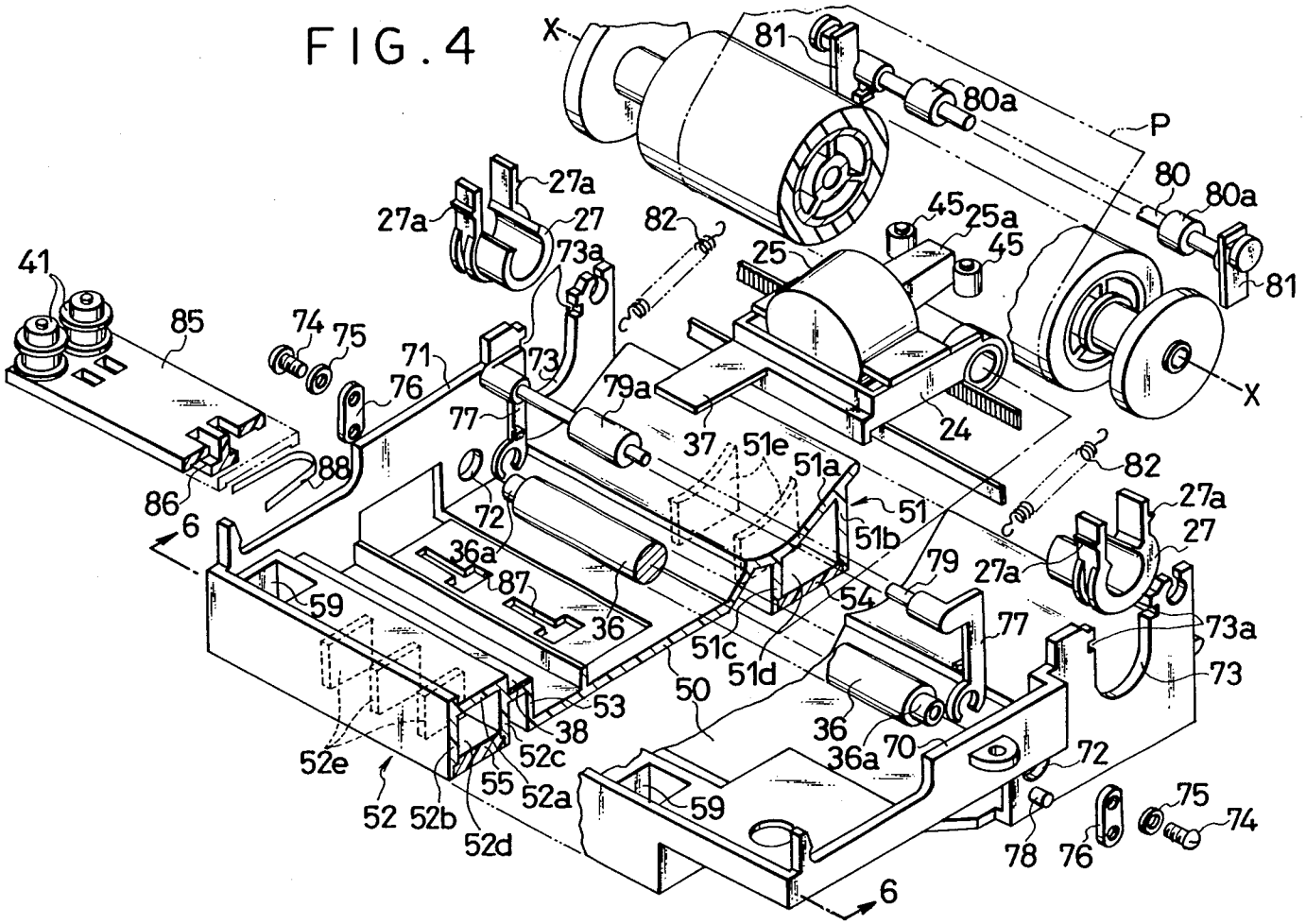
FIG. 4 is an exploded perspective view of the printing mechanism assembly mounted on a subframe.

In FIG. 4, various components of the printing mechanism assembly, mounted as a unit on the subframe 20, are shown in a disassembled state.

The subframe 20 has a pair of vertical side walls 70 and 71 integral with the bottom plate 50 and located on either side thereof. The two side walls 70 and 71 enhance the strength of the subframe 20, especially the resistance against flexure and torsion across the axis X—X of the platen 11.

Each of the side walls 70 and 71 is formed with a support hole 72 for the guide rod 36 and a U-shaped support recess 73 for the platen 11. Small-diameter end portions 36*a* of the guide rod 36 are inserted in their corresponding support holes 72 so as to be movable slightly. Each end portion 36*a* is coupled to the upper end of a rocking arm 76 by means of a screw 74 and a washer 75. A lever 77 is rockably supported, at its lower end portion, on the end portion 36*a*. The lower end portion of the rocking arm 76 is pivotally secured to a pin 78 which protrudes from each of the side walls 70 and 71. In FIG. 4, the pin 78 on the side wall 71 is not shown.

The left and right levers 77 are coupled to each other by means of a paper bail 79 which extends parallel to the axis X—X of the platen 11 in front thereof. Rollers 79*a* are supported on the bail 79.

On the other hand, a paper bail 80 at the back of the platen 11 has rollers 80*a* thereon, and is fixed, at each end thereof, to the upper end portions of levers 81. Each of the levers 81 is coupled to its corresponding front paper-bail lever 77 by a spring 82. The lower end portions (not shown) of the levers 81 are pivotally secured to their corresponding side walls 70 and 71 of the subframe 20.

When the levers 77 and 81 are mounted on the subframe 20, therefore, the rollers 79*a* and 80*a* on the front and rear paper bails 79 and 80 are continually urged to be pressed against the platen by the springs 82, so that the printing sheet P wound around the platen 11 is securely held thereon.

The urging force of the springs 82 is also transmitted to the guide rod 36 through the levers 77, continually urging the rod supporting levers 76 in the clockwise direction (FIG. 3) around the pins 78. As a result, the print head 25 on the carriage 24 is urged toward the platen 11 through the medium of the guide rod 36. Thus, in the assembled state, the gap setting rollers 45 are securely in contact with the peripheral surface of the platen 11 at all times, accurately setting the printing gap. The swing of the rocking levers 76 in the clockwise direction (FIG. 4) causes the guide rod 36 and hence the carriage 24 to move not only toward the platen 11 but also somewhat downwardly. Therefore, the guide piece 37 of the carriage 24 always accurately slides on the guide surface 38 without leaving the same. Thus, the carriage 24 can travel stably, ensuring satisfactory printing operation.

The guide pulleys 41, to which the left end portion of the endless carriage drive belt 39 is anchored, are mounted on a support plate 85. The support plate 85 is mounted on the subframe 20 in a manner such that slide blocks 86 formed integrally on the plate 85 are fitted in their corresponding slide slots 87 in the bottom plate 50 of the subframe 20. In the mounted state, the support plate 85 is allowed to slide longitudinally within a narrow range, and is urged in one direction by a leaf spring 88. The urging force of the spring 88 exerts a tensile force on the drive belt 39 through the medium of the support plate 85 and the guide pulleys 41, thereby preventing the belt 39 from slackening.

The left and right bearings 27 supporting the platen 11 are downwardly fitted in their corresponding support recesses 73 and fixed in position as a pair of projections **27*a* formed on each bearing 27 engage their corresponding notches 73*a* in each support recess 73**.

Figure 5:
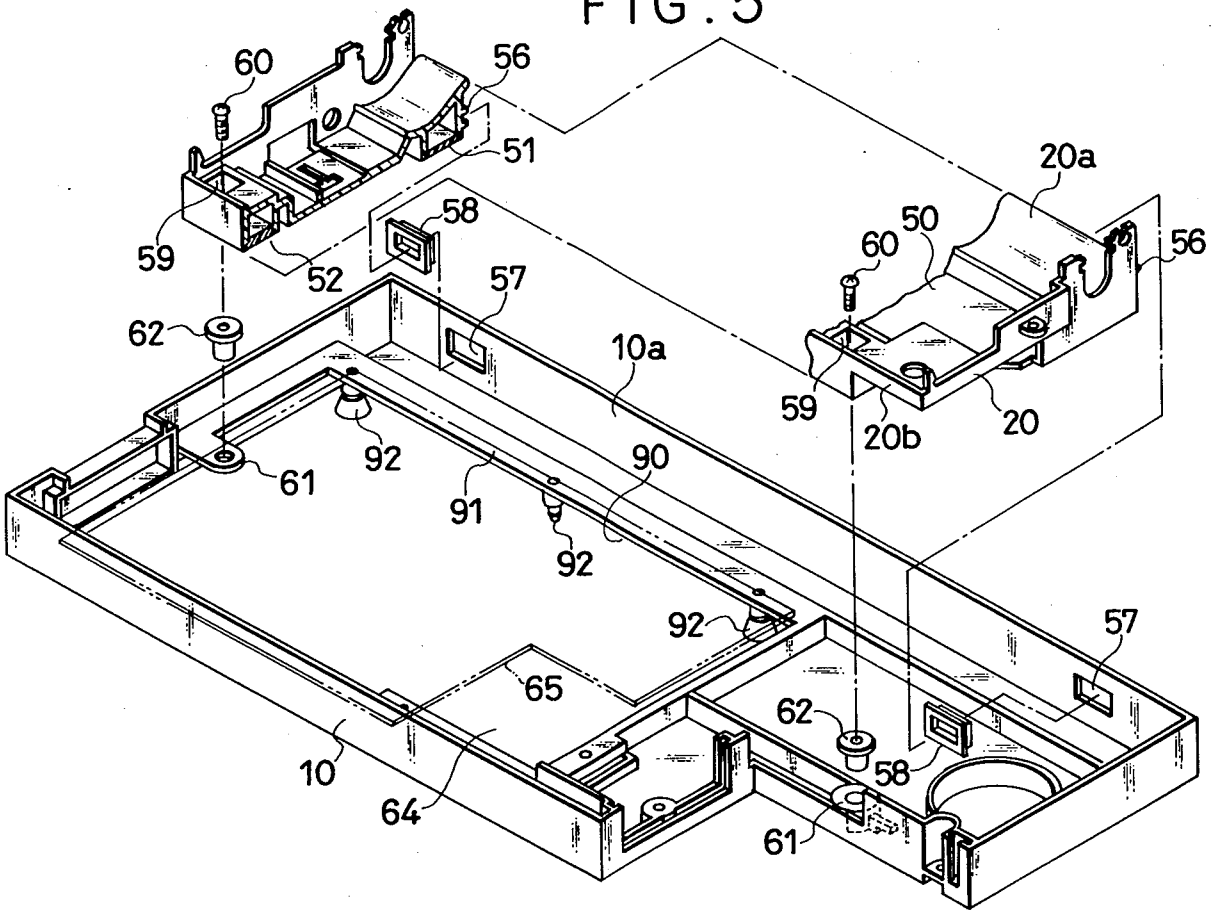
FIG. 5 is an exploded perspective view illustrating the way the subframe is mounted on a main frame.

In FIG. 5, the subframe 20 is fixed, at its front and rear end portions **20*b* and 20*a*, on the main frame 10 by the bolts 60 and the vibration-proof rubber members 62 at the mounting portions 22, and through the engagement between the engaging projections 56 and the engaging holes 57 with the aid of the vibration-proof rubber members 58 at the mounting portions 21, as already mentioned with reference to FIG. 3**.

The main frame 10 is formed with a rectangular opening 90. The printed board 65 and the bottom cover 64 supporting the same are attached, from under the main frame 10, to a flange portion 91 defining the peripheral edge of the opening 90, by means of a plurality of mounting legs 92. In this state, the printed board 65 is upwardly exposed through the opening 90. Accordingly, the printed board 65 can be accessed from above for maintenance or inspection after removing the operating cover 14 (FIG. 1). To attain this, the subframe 20 is located on the rear half region of the main frame 10 to leave the space under the operating cover 14 unoccupied.

Figure 6:
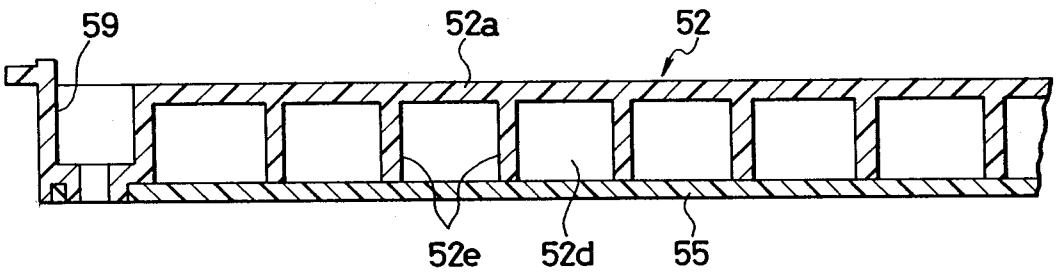
FIG. 6 is longitudinal sectional view of a reinforcing portion of the subframe taken along line 6—6 of FIG. 4.

FIG. 6 is a longitudinal sectional view of the channel-shaped reinforcing member 52 on the front side of the subframe 20. As shown in FIG. 6, the reinforcing member 52 is formed with a number of reinforcing ribs **52*e* which are arranged at predetermined intervals in the longitudinal direction of the member 52 so as to divide the channel 52*d* crosswise. The reinforcing ribs 52*e* are continuous with the top wall 52*a* and the two side walls 52*b* and 52*c*, which define the channel 52*d*, and serve to reinforce the channel structure of the reinforcing member 52. Also, the ribs 52*e* provide the reinforcing member 52 with higher resistance against flexure and torsion, without substantially increasing the weight of the member 52. The number of reinforcing ribs 52*e* arranged in the reinforcing member 52** is suitably determined at the time of designing the printer.

The configuration of the reinforcing ribs **51*e* is also shown in broken lines in FIG. 4**.

The rear reinforcing member 51, just like the front reinforcing member 52, is formed with a number of reinforcing ribs **51*e* in its channel 51*d*. The configuration of the ribs 51*e* is partially shown in broken lines in FIG. 4**.

Although the reinforcing members 51 and 52 are preferably provided with the reinforcing ribs **51*e* and 52*e***, respectively, they can exhibit due strength without the ribs. Therefore, the ribs may be omitted depending on the specifications of the printer.

The spirit and scope of the invention should not be limited to any obvious changes or modifications which would occur to those skilled in the art. The invention should be interpreted with respect to the following appended claims.

What is claimed is:

1. A printer comprising:

main frame means in the form of an open-topped box;

subframe means made of plastic material and mounted on the main frame means;

a platen having a cylindrical surace and a pair of end portions and mounted on the subframe means;

a print head opposed to the platen for printing operation;

a carriage carrying the print head thereon; and guide rod means for supporting the carriage for movement with the print head along a print line parallel to an axis for the platen and having a pair of end portions, said guide rod means being mounted on the subframe means;

said subframe means including front and rear end portions extending parallel to the axis of the platen, a bottom plate disposed between the front and rear end portions and beneath the carriage, a pair of side walls integral with the bottom plate and supporting thereon the end portions of the platen and the guide rod means, front and rear channel-shaped reinforcing members formed integrally on the bottom plate so as to extend along the front and rear end portions of the subframe means;

said subframe means further including a wall portion having an upwardly concave surface extending parallel to the axis of the platen, said concave surace underlying the platen to define, in conjunction with the cylindrical surface, of the platen, a guide path along which a printing sheet passes;

said rear reinforcing member being located under the wall portion;

said front reinforcing member and said wall portion projecting above the surface level of the bottom plate to constitute front and rear walls of the subframe means respectively;

said carriage means being located between the front reinforcing member and the wall portion;

each said front and rear reinforcing members having a bottom opening elongated in the longtudinal direction of each reinforcing member, and strip-shaped lid plates fixed individually to the front and rear reinforcing members so as to close the respective bottom openings of the reinforcing members.

2. The printer according to claim 1, wherein each said channel-shaped reinforcing member is formed integrally in with a plurality of reinforcing ribs arranged at predetermined intervals along the longitudinal direction of the reinforcing member.

3. The printer according to claim 2, wherein each said reinforcing rib extends across the longitudinal direction of the reinforcing member corresponding thereto.

4. The printer according to claim 1, wherein each said channel-shaped reinforcing member is square and U-shaped in cross section.

5. The printer according to claim 1, wherein said subframe means has a guide surface formed integrally therewith so as to extend parallel to the axis of the platen, and said carriage includes a guide portion adapted to be slidingly guided by the guide surface when moving.

6. A printer comprising:

a main frame in the form of an open-topped box having a rear wall;

a platen having a pair of end portions;

a subframe made of plastic material and mounted on the main frame, said subframe having front and rear end portions extending parallel to an axis of the platen said rear end portion corresponding to said wall of the main frame;

a print head opposed to the platen for printing operation;

a carriage carrying the print head thereon;

guide rod means for supporting the carriage for movement with the print head along a print line parallel to the axis of the platen and mounted on the subframe;

first and second mounting means for mounting the subframe on the main frame at the front and rear end portions of the subframe, respectively, one of said first and second mounting means including an engaging projection formed on one of the rear end portion and the rear wall and an engaging recess formed on the other of the rear end portion and the rear wall, thereby detachably coupling the subframe to the main frame along a horizontal direction;

the other mounting means including a bolt adapted to vertically engage both the frames, thereby fixedly coupling the subframe to the main frame along a vertical direction;

a first vibration-proof rubber member interposed between the engaging projection and recess so as to be elastically in intimate contact with the outer peripheral surface of the projection and the inner peripheral surface of the recess; and a second vibration-proof rubber member penetrated by the bolt and interposed between the subframe and the main frame.

7. The printer according to claim 6, further comprising front and rear channel-shaped reinforcing members formed integrally on the subframe so as to extend along the front and rear end portions, respectively, each said reinforcing member having a bottom opening, and a lid plate fixed to each reinforcing member so as to close the bottom opening of the reinforcing member.

8. The printer according to claim 7, wherein each said reinforcing member has reinforcing ribs formed inside and integrally with the reinforcing member at predetermined intervals along the longitudinal direction of the reinforcing member.

9. The printer according to claim 9, wherein said engaging protrudes from an outer surface of the rear reinforcing member, said recess is formed in a rear wall of the main frame, and said front reinforcing member is formed, at each end portion thereof, with a through hole in which the bolt is inserted.

* * * * *